US005506000A

United States Patent [19]

Leonard

[11] Patent Number: 5,506,000

[45] Date of Patent: Apr. 9, 1996

[54] SLOT COATING METHOD AND APPARATUS

[75] Inventor: William K. Leonard, Troy Township, County of St. Croix, Wis.

[73] Assignee: Minnesota Mining and Manufacturing Company, St. Paul, Minn.

[21] Appl. No.: 382,964

[22] Filed: Feb. 2, 1995

[51] Int. Cl.[6] ..... B05D 1/36; B05C 5/00

[52] U.S. Cl. ..... 427/402; 427/420; 118/410; 118/411; 118/324; 118/DIG. 4

[58] Field of Search ..... 427/402, 420; 118/410, 411, 324, DIG. 4

[56] References Cited

U.S. PATENT DOCUMENTS

| | | |
|---|---|---|
| Re. 24,906 | 12/1960 | Ulrich . |
| 2,135,406 | 11/1938 | MacDonald . |
| 2,139,628 | 12/1938 | Terry . |
| 2,761,419 | 9/1956 | Mercier et al. . |
| 2,761,791 | 9/1956 | Russell . |
| 3,005,440 | 10/1961 | Padday . |
| 3,508,947 | 4/1970 | Hughes . |
| 3,632,378 | 1/1972 | Busch . |
| 3,632,403 | 1/1972 | Greiller . |
| 3,916,077 | 10/1975 | Damrau . |
| 4,093,757 | 6/1978 | Barrand et al. . |
| 4,348,432 | 9/1982 | Huang . |
| 4,472,480 | 9/1984 | Olson . |
| 4,504,645 | 3/1985 | Melancon . |
| 4,748,043 | 5/1988 | Seaver et al. . |
| 4,978,731 | 12/1990 | Melancon et al. . |
| 5,234,500 | 8/1993 | Korokeyi . |
| 5,332,797 | 7/1994 | Kessel et al. . |

FOREIGN PATENT DOCUMENTS

| | | |
|---|---|---|
| 0562975A2 | 9/1993 | European Pat. Off. . |
| 2-173080 | 7/1990 | Japan . |
| 2-207870 | 8/1990 | Japan . |

*Primary Examiner*—Shrive Beck
*Assistant Examiner*—Katherine A. Bareford
*Attorney, Agent, or Firm*—Gary L. Griswold; Walter N. Kirn; Charles D. Levine

[57] ABSTRACT

An apparatus and method of flowing a fluid onto an incline planar surface across the entire with of the slot has a slot capillary number less than 0.04. The slot exit gap S is selected to be less than $$\frac{6.25\mu^2 N_{re}^a}{\rho\sigma}$$

where S is the slot gap in cm, μ is the fluid viscosity measured in poise, ρ is the liquid density measured in gm/cm$^3$, σ is the liquid surface tension measured in dyne/cm, and $N_{re}$ is the Reynolds number as defined by $N_{re}$=4M/μ, where M is the liquid flow rate per unit of width measured in gm/sec-cm. The expression for a is defined as 0.981+0.3406 log $N_{re}^{0.3406}$. The fluid is flowed through a slot exit.

13 Claims, 3 Drawing Sheets

SLOT COATING METHOD AND APPARATUS

TECHNICAL FIELD

This invention relates to coating a substrate with single and multiple fluid layers. In particular, the invention relates to improvements for bead and curtain coating when a slide die is used. This technology is particularly useful for paper coating, and the manufacture of photographic films, magnetic recording media, adhesive tapes, and the application of optical coatings.

BACKGROUND OF THE INVENTION

Often, single or multiple layers of differing compositions must be applied to a substrate. For example, in the manufacture of photographic film as many as twelve layers of differing compositions must be applied in a distinct layered relationship. Close tolerances on uniformity are required. The use of sequential coating operations can produce a plurality of distinct superposed layers on a substrate, or all of the layers can be simultaneously applied in one station. In using coating technology it is desirable to produce layers that are no thicker than is necessary to achieve a desired function. Indeed, a prime motivation for simultaneous multilayer coating is that by grouping layers together in a composite the individual layers may be so thin that they are impossible to coat as individual layers. Also, thicker wet coatings would increase the material cost of the products. Similarly, it is desirable to reduce the amount of solvent in coating fluid formulations. While solvents and diluents make formulations easier to process by lowering viscosity and increasing the bulk volume, their cost and the cost of safely disposing of them is undesirable.

One important style of coating die popular in the photographic industry is the slide coater. U.S. Pat. No. 2,761,419 teaches its use for multilayer coating. This coating die is also useful for thin single layer coating. FIG. 1 illustrates the features of a multilayer coating die 10'. This die has three plates 12, 14, 16 separated by fluid distribution slots 18, 20 arranged so that the fluids exit from the slots onto incline planes 22, 24 and flow down them. At the termination of the plane 24, the coating fluid is transferred from the die lip 26 across a small gap to a moving substrate 28.

Slide curtain coating is disclosed in U.S. Pat. No. 3,632,403. At the end of the incline plane of the slide die, the fluid is allowed to separate and fall by gravity as a sheet before contacting the moving substrate. FIG. 2 illustrates such coating die. An improvement on this is its use for simultaneous multilayer curtain coating. U.S. Pat. No. 3,508,947 teaches this method for coating photographic elements. Still another style of slide curtain die is shown in the Japanese application 51-39264 where the orientation of the slot and inclines onto which the coatings exit are inverted with respect to gravity.

In coating operations, coating dies often become contaminated with low surface energy materials. This may cause coating defects and dramatically raise the probability of producing scrap material. The production of coated products of reactive or curing coating fluids often requires frequent cleaning of the slide die surfaces to avoid unwanted encrustations of gelled material. Cleaning can be facilitated by covering the die surfaces with lower energy release materials such as silicones or polytetrafluoroethylene. It is therefore desirable to modify the coating dies to allow coating when the surfaces have low surface energies.

DEVELOPMENT OF THE INVENTION

Copending application Ser. No. 08/382,962 by W. K. Leonard et. al. discloses the use of slide dies for thin coating with the use of carrier fluids. Fluids are caused to flow out of a slot onto the incline face of the die and then into a composite layer. For single layer coating, a ribbon of coating fluid and a ribbon of carrier fluid flow through slot exits onto the slide face of the die. While previously known die coating techniques are practiced with coating flow rates in the range of 0.5 to 5 cubic centimeters per second per centimeter of slot width [$cm^3$/(sec-cm)], this method often uses flows in the range of 0.00005 to 0.005 cc/(sec-cm), one thousand to ten thousand times smaller. The carrier fluid in this process often has a very low viscosity. While common coating fluids have viscosities of 10 to 10000 centipoise, the carrier fluids may fall in the range of 0.2 to 1 centipoise. In some cases it is advantageous to use carrier fluids with densities of 8 to 13 $gm/cm^3$ (liquid metals) as contrasted to common coating fluids which range from 0.7 to 1.1 $gm/cm^3$. Also it may be advantageous to use carrier fluids with very high surface tensions. Common coating fluids employed commercially have tensions ranging from 20 to 60 dyne/cm. Liquid metals have surface tensions of 100 to 1000 dyne/cm, and molten inorganic salts have surface tensions often in the hundreds of dyne/cm. It has been found that the extremes in fluid properties or the very low slot flow rates often make it difficult to obtain continuous, full-width ribbons of fluid exiting from the coating fluid slot or the carrier fluid slot exit.

When a fluid does not wet the surface of the incline plane of a slide die (the fluid beads up or the fluid wetting line retracts, typically at large contact angles), it is difficult to maintain a continuous uniform ribbon of fluid across the width of the die flowing down the incline plane at low flow rates. At low flow rates the flow will often and unpredictably cease to flow as a ribbon from the slot across the full width of the slot. It will flow from some portions of the slot and not other portions. With low viscosity fluids the ribbon will often break into many narrow ribbons. In other cases, the initial single ribbon may be reduced to less than the full slot exit width immediately at the slot exit. This is a slot flow exit instability. While a small lessening of the ribbon width flowing from the slot is not necessarily disastrous, the inventor has found that this diminished width ribbon is prone to bifurcating unpredictably into multiple ribbons, especially on wide-width dies. This unstable mode of flow creates large amounts of unusable product. Under such circumstances, it is impossible to coat high quality with good productivity.

To understand the problem it is useful to define a dimensionless number called the capillary number ($N_{ca}$) which is directly proportional to the fluid slot exit velocity. It is calculated from the equation $N_{ca}=\mu U/\sigma$ where p is the viscosity of the fluid measured at the apparent slot wall shear rate; U is the average fluid velocity at the exit of the slot; and $\sigma$ is the surface tension of the fluid at the slot exit measured in combination with the fluid that covers the exit. The exit flow instability is particularly troublesome when flow rates are small, especially when the capillary number is less than about 0.04. In the past, commercial coating operations have not encountered the instability because they operated at capillary numbers 10 to 1000 times higher. However, with the drive toward the economies of thinner coatings, there is a need to reliably operate at very low slot capillary numbers while avoiding the instability.

When coating with the apparatus and method disclosed in copending application Ser. No. 08/382,623 by W. K.

Leonard et. al., the capillary number of the coating fluid will commonly range from 0.00001 to 0.02. If the carrier fluid is water the capillary number will range from 0.0001 to 0.02. If the carrier fluid is a liquid metal the capillary number will range from 0.00003 to 0.01.

The exit flow instability is avoided if the fluid wets the surface of the incline or spontaneously spreads on it. It is common to lower the fluid surface tension through the addition of surfactants for various reasons. These are often included to aid wetting of the substrate to be coated, to level the coating on the substrate, and to minimize edge beads. This lowering of the surface tension also often simultaneously achieves wetting of the incline and practitioners of the art of coating have not been forced to deal with the instability and have avoided it. While the inventor has recognized it is useful to lower the surface tension to achieve wetting, this is not universally applicable and other methods must be found. If the surface of the incline is composed of a material that has a low surface energy such as polytetrafluoroethylene it is difficult to find a surfactant that allows wetting. If the surface is covered with a low energy oil, it is also difficult to find a surfactant that allows wetting. If the fluid is a molten inorganic salt or a liquid metal there may be no known surfactant that lowers its surface tension, Even if a surface tension lowering agent can be found to produce wetting, it may chemically interact with the coating fluid components or the substrate or in some other unpredictable way destroy the function or degrade the quality of the product being coated. Therefore, a method to avoid the slot exit instability is needed that does not require changes in the coating fluid composition and does not rely on the fluid wetting the slide surface.

SUMMARY OF THE INVENTION

This invention produces thinner uniform fluid layers, allows slide dies to coat in the presence of contaminants, and allows coating in the presence of low energy die surfaces which coating fluids commonly do not wet.

This invention broadens the range of utility of fluid distribution devices, especially slide and slide curtain coater dies. The invention provides a method and apparatus of flowing a continuous ribbon of fluid at low capillary numbers onto an incline surface without break-up into two or more ribbons or a diminishing of the fluid ribbon width at the slot exit.

The invention flows a fluid onto an incline planar surface across the entire with of the slot. When the capillary number of the slot is less than 0.04, this is done by using a selected range of slot gap. The slot exit gap S is selected to be less than the critical slot gap defined by equation (1).

$$S=\frac{6.25\,\mu^2 N_{re}^a}{\rho\sigma}\,.$$

The fluid is flowed through a slot exit as a single continuous ribbon without needing to lower surface tension to achieve wetting on the surface of the slot or die face.

In one embodiment, the slot exit gap S can be selected to range from 0.5 through 0.8 times the critical slot gap defined by equation (1). In another embodiment, the slot exit gap can be selected to be less than 0.5 times than the critical slot gap.

The fluid can be a coating fluid for use in a coating process. The fluid can be one of water, a latex, a water solution, a liquid metal, a molten inorganic salt, a molten organic material, and a supercritical fluid. Alternatively, the fluid can be water soluble, and the fluid can include materials responsive to electromagnetic fields or electromagnetic radiation.

The apparatus of this invention includes a slot formed of first and second plates spaced from each other. The slot exit gap S is less than the critical slot gap defined by equation (1). The slot flow can have a capillary number less than 0.04 and the slot can be part of a coating die. The coating die can be one of a slide, curtain, bead, or extrusion coating die.

DETAILED DESCRIPTION

This invention broadens the utility range of fluid distribution devices, especially slide and slide curtain coater dies, but can be used with any fluid distribution devices. The invention provides a method and apparatus of flowing a continuous ribbon of fluid at low capillary numbers onto an incline surface without break-up into two or more ribbons or without diminishing the fluid ribbon width at the slot exit. Making intensive studies, the present inventor found that the viscosity, surface tension, density, and mass flow rate of the fluid; and the slot gap all greatly influence the instability. As the result of still further investigation, this invention was achieved.

In the method and apparatus of this invention, fluids may flow from slots exiting onto incline solid surfaces to form a ribbon of fluid extending across the full width of the slot at its exit when the fluid does not wet the material surface of the incline. A slot exit gap dimension matches the flow rate and fluid properties in a manner to avoid the instability. The slot exit gap can be less than the critical gap where the critical gap is given by equation (1):

$$S=\frac{6.25\,\mu^2 N_{re}^a}{\rho\sigma} \tag{1}$$

where S is the slot gap in cm, $\mu$ is the fluid viscosity measured in poise, $\rho$ is the liquid density measured in gm/cm$^3$, $\sigma$ is the liquid surface tension measured in dyne/cm, and $N_{re}$ is the Reynolds number defined in equation (2)

$$N_{re}=4M/\mu \tag{2}$$

where M is the liquid flow rate per unit of width measured in gm/sec-cm. The exponent a is an expression defined in equation (3) as follows:

$$a=0.981+0.3406\ log\ N_{re}0.3406 \tag{3}$$

Figure 3:
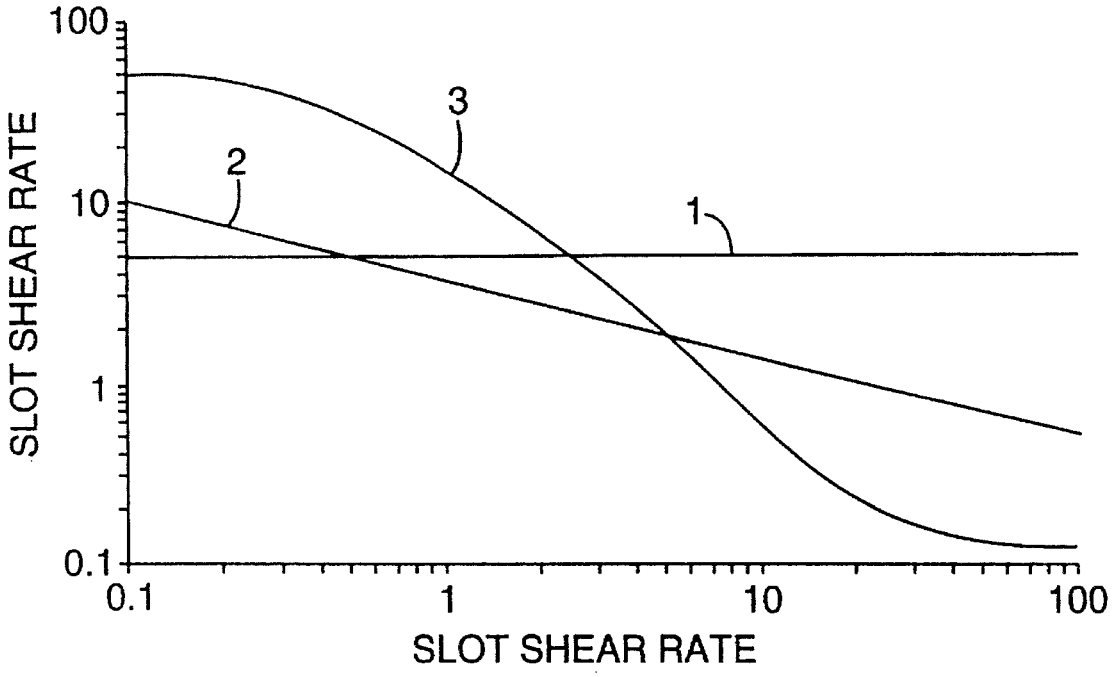
FIG. 3 is a graph comparing three common types of viscosity curves.

The viscosity of the fluid may be easily determined from its characteristic curve at the apparent shear rate effective at the slot exit. FIG. 3 illustrates three common types of viscosity curves. Curve 1 exemplifies a Newtonian liquid where the viscosity is invariant with shear rate. Curve 2 exemplifies a so called "powerlaw" fluid where the logarithm of the viscosity is a linear function of the logarithm of the shear rate, and curve 3 exemplifies another liquid where the viscosity varies in a known but more complicated manner with the shear rate. Even if the fluids are non- Newtonian, the apparent shear rate can be directly determined from equation (4):

$$y = 6Q/WS^2 \quad (4)$$

where S denotes the slot gap in cm measured perpendicular to the slot surfaces at the slot exit onto the incline plane, W denotes the width in cm of the slot opening onto the plane across the width of the die, and Q is the volumetric flow rate exiting from the slot in $cm^3$/sec.

The flow rate exiting from the slot is chosen to meet the desired characteristics of the coated product, including final wet coating caliper on the substrate, the width of the substrate to be coated, and the speed of the substrate moving through the coating station. The surface tension of the fluid as it exits the slot, is primarily influenced by the chemical composition of the fluid and fluid medium surrounding the slot exit. Since new fresh fluid surface is being exposed as it exits the slot, the proper surface tension is that which is measured immediately after new surface is formed.

The method of flowing a fluid from a slot onto an incline solid plane surface using this invention will be clarified by the following examples.

EXAMPLE 1

Figure 1:
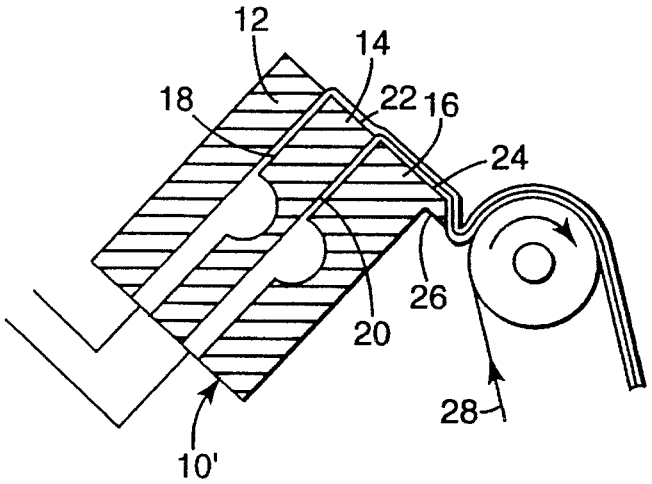
Fig. 1 PRIOR ART
FIG. 1 is a schematic view of a known multilayer die.
Figure 2:
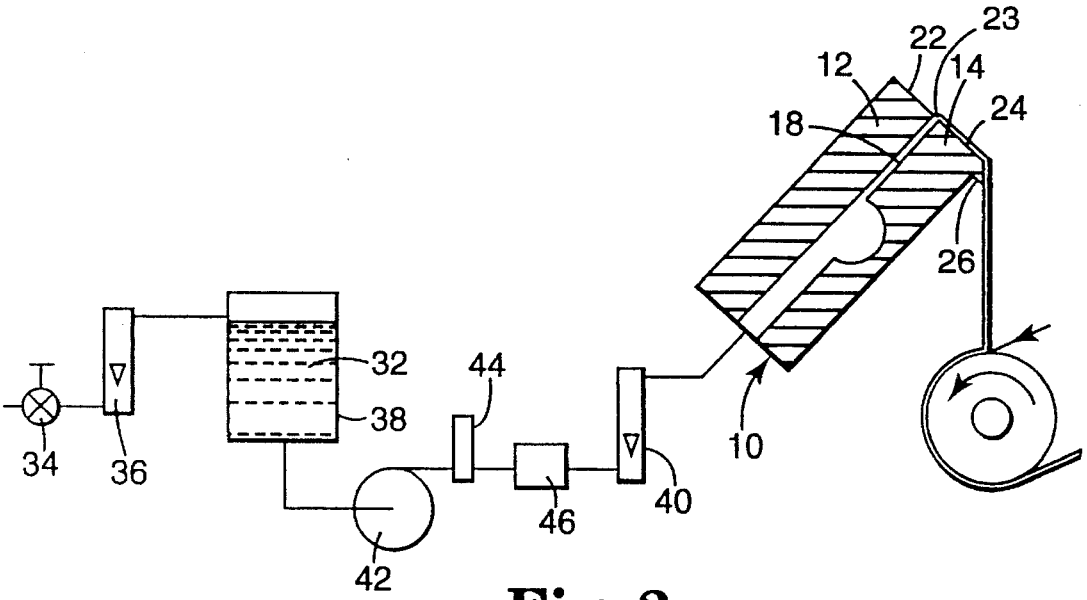
FIG. 2 is a schematic view of a single-layer die.

This example is best understood by referring to the slide curtain coating die shown in the FIG. 2 which shows a coating station that can be improved using this invention. The slide die 10 was mounted so that slot 18 was oriented at a 25° angle from horizontal.

A layer of Mobil 1™, 5W-30 motor oil manufactured by the Mobil Oil Corporation of New York, N.Y. was applied as a contaminant to create non-wetting surfaces on the incline faces 22, 24. The test fluid 32 used was tap water from the municipal water supply without any surface tension modifying additives. The water was supplied through a throttling valve 34 and flow meter 36 to a vacuum degassing vessel 38 operated at a pressure of 115 mm of mercury absolute.

The water flow rate was measured both entering and leaving the vacuum degassing vessel with two identical rotometers 36, 40. These were model 1307EJ27CJ1AA, 0.2 to 2.59 gpm meters purchased from the Brooks Instrument Corporation of Hatfield, Pa. The flow from the vessel was pumped by a progressive cavity pump 42 model 2L3SSQ-AAA, Moyno™ pump of the Robbins and Meyers Corporation of Springfield, Ohio. In order to obtain a vacuum seal through this pump, it was run in reverse of its normal operation. That is, its rotor was rotated opposite of the standard direction and water was pumped from the vacuum vessel through the normal Moyno™ discharge port, through the pump and out from the feed opening. From the pump, the water flowed through a one-liter sealed surge tank 44, through a fine filter 46, through the discharge rotometer and into the coating die 10. The inlet flow rate was manually adjusted by a flow throttling value at the inlet rotometer inlet. The vacuum vessel water discharge flow rate was controlled by the speed of rotation of the Moyno™ pump and monitored by the discharge rotometer. During operation the inlet flow rate was manually adjusted with the throttling valve to match the indicated discharge rate. The filter used was a disposable filter capsule. This was purchased from the Porous Media Corporation of St. Paul, Minn., and it was identified as part number DFC1022Y050Y, rated for 5 microns. Vacuum to the degassing vessel was supplied by a water ring vacuum pump, model MHC-25 from the Nash Engineering Corporation of Downers Grove, Ill. After first setting the water flow rate to obtain a continuous ribbon of fluid flow out of the slot and down the incline face 24, the water flow rate set at a series of differing rates and the ribbon observed. This was done with several die slot gaps and a slot width of 25.4 centimeters. The water viscosity was estimated based on *Perry's Chemical Engineers Handbook, 4th ed.,* Perry et al, Table 3-267, p. 201, McGraw Hill, New York. The surface tension was measured as 70 dyne/cm and the density as 1.0 gm/$cm^3$. The water temperature was 11° C. The die face 24 was inclined at an angle of 65° from the horizontal. Distributing slot exit gap 23 between the plates 22, 24 was set at four values for this example: 0.102, 0.052, 0.081, 0.027 cm.

The tests were performed by setting the slot gap, then varying the flow rate. In this manner, the critical gap calculated from equation (1) is compared to the actual gap. The presence of multiple ribbons or a diminished ribbon width at the slot exit was observed. The test fluid would not wet the die incline surface. The results are presented in Table 1.

TABLE 1

Comparison of fluid ribbon widths at the exit slot with critical slot gap and the actual slot gap

| Case | SLOT FLOW (cc/min) | SLOT CAPILLARY NUMBER - Nca (dimensionless) | CRITICAL GAP from equ. 1 (cm) | SLOT GAP (cm) | DIFFERENCE critical – actual | OBSERVATIONS |
|---|---|---|---|---|---|---|
| a | 5034 | .0073 | .402 | .081 | Positive | Full slot width ribbon |
| a | 2252 | .0033 | .040 | .081 | Negative | Full slot width ribbon |
| a | 1893 | .0028 | .030 | .081 | Negative | Ribbon width reduced to 24 cm |
| a | 1552 | .0023 | .022 | .081 | Negative | Ribbon width reduced to 20 cm |
| a | 683 | .0010 | .006 | .081 | Negative | Ribbon width reduced to 18 cm |
| a | 575 | .0008 | .005 | .081 | Negative | Ribbon width reduced to 8 cm |
| b | 5053 | .0058 | .150 | .102 | Positive | Full slot width ribbon |
| b | 3520 | .0041 | .082 | .102 | Negative | Full slot width ribbon |
| b | 2082 | .0024 | .035 | .102 | Negative | Ribbon width reduced to 20 cm |
| b | 1438 | .0017 | .020 | .102 | Negative | Ribbon width reduced to 18 cm |
| b | 1012 | .0012 | .011 | .102 | Negative | Ribbon width reduced to 14 cm |
| b | 550 | .0006 | .005 | .102 | Negative | Ribbon width reduced to 9 cm |

TABLE 1-continued

Comparison of fluid ribbon widths at the exit slot with critical slot gap and the actual slot gap

| Case | SLOT FLOW (cc/min) | SLOT CAPILLARY NUMBER - Nca (dimensionless) | CRITICAL GAP from equ. 1 (cm) | SLOT GAP (cm) | DIFFERENCE critical – actual | OBSER-VATIONS |
|---|---|---|---|---|---|---|
| b | 313 | .0004 | .002 | .102 | Negative | Ribbon width reduced to 5 cm |
| c | 3823 | .0168 | .094 | .027 | Positive | Full slot width ribbon |
| c | 2536 | .0111 | .048 | .027 | Positive | Full slot width ribbon |
| c | 625 | .0027 | .006 | .027 | Negative | Ribbon width reduced to 24 cm |
| c | 505 | .0022 | .004 | .027 | Negative | Ribbon width reduced to 24 cm |
| c | 175 | .0008 | .001 | .027 | Negative | Ribbon width reduced to 21 cm |
| d | 4731 | .0109 | .135 | .052 | Positive | Full slot width ribbon |
| d | 3709 | .0086 | .090 | .052 | Positive | Full slot width ribbon |
| d | 3331 | .0077 | .076 | .052 | Positive | Full slot width ribbon |
| d | 1249 | .0029 | .016 | .052 | Negative | Ribbon width reduced to 25 cm |
| d | 650 | .0015 | .006 | .052 | Negative | Ribbon width reduced to 22 cm |

It has been found that the instability of the fluid ribbon issuing from a slot onto an incline planar surface is likely to be prevented if the slot gap is chosen to be less than that given by the critical gap from equation (1). In this first example, there is a direct correspondence between critical gap, the actual gap and the slot exit flow instability. As noted in column six of the table, whenever the difference between the critical gap minus the actual gap is positive, the instability is avoided. Whenever the difference between the critical gap minus the actual gap is near zero or negative, the instability usually produces an unwanted narrowing of the ribbon of fluid as it exits the slot. These reduced-width ribbons were often observed to bifurcate as time passed, often repeatedly, producing multiple ribbons on the incline.

EXAMPLE 2

This example is best understood by referring to the slide curtain coating die shown in the FIG. 2. The slide die 10 was mounted so that the slot 18 was oriented at a 25° angle from horizontal. A layer of Mobil 1™, 5W-30 motor oil manufactured by the Mobil Oil Corporation of New York, N.Y. was applied as a contaminant to create non-wetting surfaces on the incline faces 22, 24. The slot test fluid 32 used was mixtures of glycerin and tap water from the municipal water supply without any surface tension modifying additives. The glycerin-water mixture was supplied at room temperature directly from the degassing vessel 38. The vacuum degassing vessel 38 operated at atmospheric pressure. No degassing was necessary with these mixtures as they were allowed to naturally degas with exposure to the atmosphere in an open vessel. The throttling valve 34 and flow meter 36 were not used; the vessel 38 was filled with the mixture before testing. In every case the test fluid would not wet the die inclined surface.

The test procedures were identical to Example 1, with the addition that the concentration of the glycerin was also changed during the investigation. Again both slot gaps and flow rates were varied. The tests were performed, and the critical gap calculated from equation (1) was compared to the actual gap. The ribbon appearance at the slot exit was noted. The results are presented in Table 2. The flow of a ribbon of fluid at the slot exit of a width less than full slot width is a manifestation of the slot exit flow instability.

The table shows a direct correspondence between critical gap, the actual gap and the slot exit flow instability. As noted in column 7 of Table 2, whenever the difference between the critical gap minus the actual gap is positive, the instability is avoided. Whenever the difference between the critical gap minus the actual gap is near zero or negative, the instability produces an reduction in the ribbon width.

TABLE 2

Comparison of fluid ribbon widths with critical slot gap and actual slot gap for glycerin-water

| SLOT FLOW (cc/sec) | Viscosity (poise) | Density (g/cc) | Surface Tension dyne/cm | CRITICAL GAP from equ. 1 (cm) | SLOT GAP (cm) | DIFFER-ENCE (critical – actual) | OBSER-VATIONS |
|---|---|---|---|---|---|---|---|
| 53.3 | .117 | 1.13 | 52.0 | .288 | .102 | Positive | Full slot width ribbon |
| 33.6 | .117 | 1.13 | 52.0 | .151 | .102 | Positive | Full slot width ribbon |
| 2.3 | .117 | 1.13 | 52.0 | .005 | .102 | Negative | Width reduced to 23 cm |
| 80.0 | .117 | 1.13 | 52.0 | .517 | .082 | Positive | Full slot width ribbon |
| 33.3 | .117 | 1.13 | 52.0 | .149 | .082 | Positive | Full slot width ribbon |
| 2.3 | .117 | 1.13 | 52.0 | .005 | .082 | Negative | Width reduced to 23 cm |
| 33.3 | .117 | 1.13 | 52.0 | .149 | .053 | Positive | Full slot width ribbon |
| 33.3 | .117 | 1.13 | 52.0 | .149 | .027 | Positive | Full slot width ribbon |
| 33.5 | .057 | 1.12 | 50.9 | .100 | .027 | Positive | Full slot width ribbon |
| 35.2 | .033 | 1.09 | 56.3 | .067 | .027 | Positive | Full slot width ribbon |

EXAMPLE 3

The apparatus of Example 2 was used but the die slot and incline surfaces were covered with polytetrafluoroethylene to create non-wetting surfaces on the inclined faces 22, 24. The slide face 24 was inclined at 60°. The fluid 32 used was mixtures of glycerin, ethylene glycol and tap water, and the composition was varied to obtain viscosities ranging from 0.01 to 2.5 poise. Slot gaps and fluid flow rates were varied so as to span the range of Reynolds numbers of 0.05 to 600. The capillary number for the slot exit flow varied from 0.002 to 0.05. The mixture was supplied at room temperature directly from the degassing vessel 38. In every case the test fluid would not wet the die inclined surface.

Figure 4:
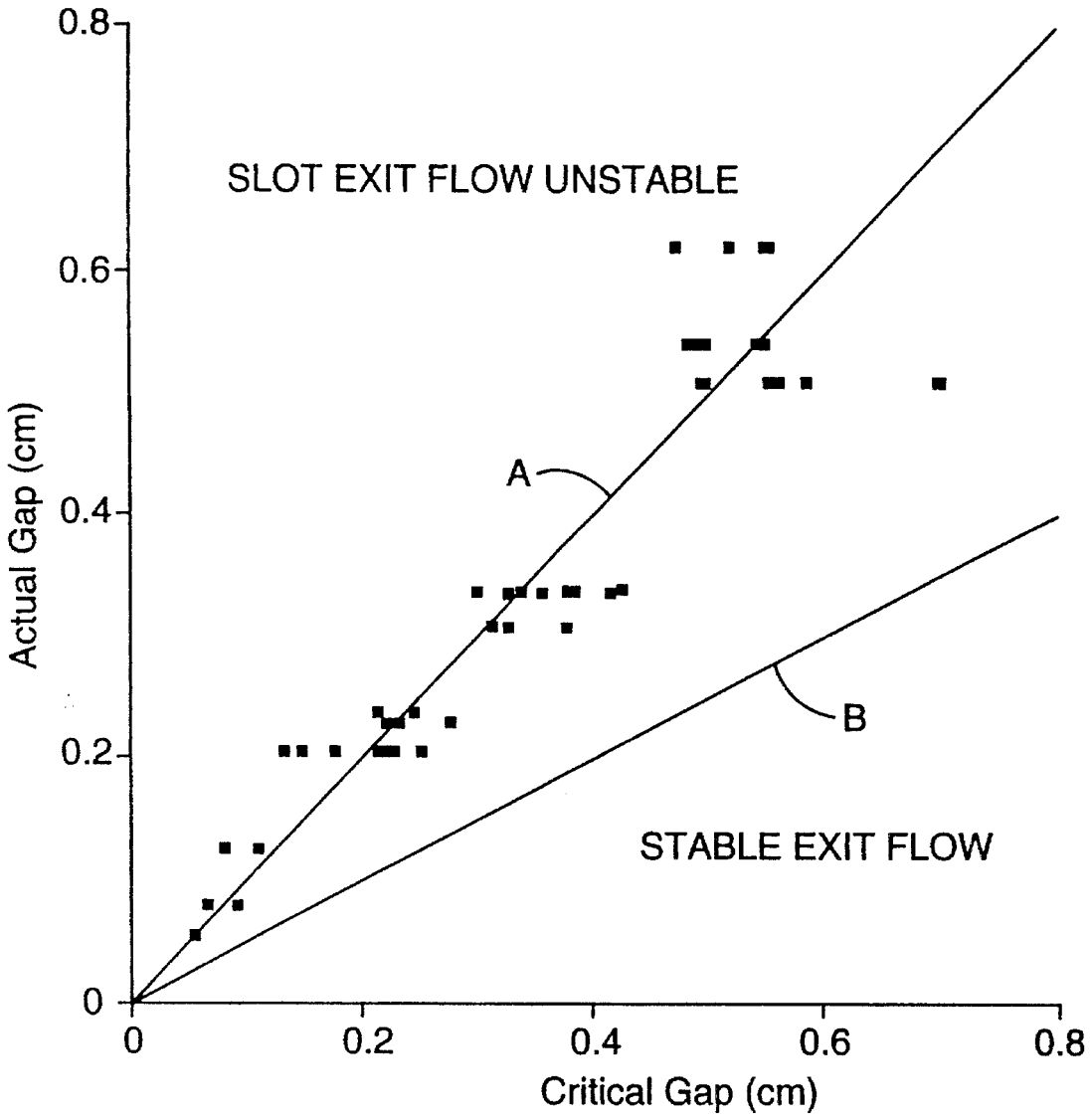
FIG. 4 is a graph showing the experimental verification of equation (1).

In this example the critical flow rate for a set gap was determined by starting at a high flow rate for a given slot gap and fluid. Upon reducing the flow, at some point the ribbon of fluid exiting from the slot began to be reduced in width or the ribbon separated into one or more ribbons. This set of conditions was used to define the gap at which the exit flow became unstable. Curve A of FIG. 4 shows a good correlation is obtained between the experimental gap for instability onset and the critical gap predicted by equation (1).

A critical gap has been found that is related to fluid properties and flow rates. If gaps near critical are used, the slot exit flow instability is prone to occur. As with other fluid flow instability regions it is best to avoid them by wide margins. Therefore, it is preferred to use gaps that are smaller than 0.8 times the critical, and most preferably to use gaps smaller than 0.5 times the critical (curve B of FIG. 4). Many modifications may be possible. For example, one may use compound slots that are large in the interior of the die but change to a narrow gap at the slot exit. Additionally, slots that have obstructions partially filling the gap at the exit such as a wire stretched across the width of the gap in the slot exit so as to restrict the gap is a modification which falls within the scope of this invention. Other means of restricting the gap opening, raising the fluid slot velocity at the exit, locally changing the fluid density, viscosity or surface tension at the slot exit are within the scope of this invention.

I claim:

1. A method of flowing a fluid from a slot onto an incline planar surface across an entire width of the slot wherein the slot has a capillary number less than 0.04 and wherein the fluid has a fluid viscosity, a fluid density, a fluid surface tension, a Reynolds number, and a fluid flow rate, and wherein the fluid does not wet the incline planar surface, wherein the method comprises the steps of:

selecting a slot exit gap S which is less than $$\frac{6.25\mu^2 N_{re}^a}{\rho\sigma}$$

where S is the slot gap in cm, $\mu$ is the fluid viscosity measured in poise, $\rho$ is the fluid density measured in gm/cm$^3$, $\sigma$ is the fluid surface tension measured in dyne/cm, $N_{re}$ is the Reynolds number defined by $N_{re}=4M/\mu$, where M is the fluid flow rate per unit of width measured in gm/sec-cm, and a is an expression defined as $0.981+0.3406 \log N_{re}^{0.3406}$; and flowing the fluid through the slot exit.

2. The method of claim 1 wherein the selecting step comprises selecting a slot exit gap S which ranges from 0.5 through 0.8 times $$\frac{6.25\mu^2 N_{re}^a}{\rho\sigma}.$$

3. The method of claim 1 wherein the selecting step comprises selecting a slot exit gap S which is less than 0.5 times $$\frac{6.25\mu^2 N_{re}^a}{\rho\sigma}.$$

4. The method of claim 1 wherein the step of flowing the fluid through the slot exit comprises flowing a coating fluid for use in a coating process.

5. The method of claim 1 wherein the fluid is one of water, a latex, a water solution, a liquid metal, a molten inorganic salt, a molten organic material, a supercritical fluid, a liquid mixture, and an organic liquid.

6. The method of claim 1 wherein the fluid is water miscible.

7. The method of claim 1 wherein the fluid comprises materials that are affected by electromagnetic fields.

8. The method of claim 1 wherein the fluid comprises materials that are affected by electromagnetic radiation.

9. An apparatus for flowing a fluid from a slot onto an incline planar surface across an entire width of the slot while preventing the fluid from wetting the incline planar surface, wherein the fluid has a fluid viscosity, a fluid density, a fluid surface tension, a Reynolds number, and a fluid flow rate, and wherein the apparatus comprises:

first and second plates spaced from each other to form a slot having an exit gap through which the fluid can flow, wherein the slot exit gap S is less than $$\frac{6.25\mu^2 N_{re}^a}{\rho\sigma}$$

where S is the slot gap in cm, $\mu$ is the fluid viscosity measured in poise, $\rho$ is the fluid density measured in gm/cm$^3$, $\sigma$ is the fluid surface tension measured in dyne/cm, $N_{re}$ is the Reynolds number as defined by $N_{re}=4M/\mu$, where M is the fluid flow rate per unit of width measured in gm/sec-cm, and a is an expression defined as $0.981+0.3406 \log N_{re}^{0.3406}$.

10. The apparatus of claim 9 wherein the slot has a capillary number less than 0.04.

11. The apparatus of claim 9 wherein the slot and surface are parts of a coating die.

12. The apparatus of claim 11 wherein the fluid is a coating fluid and the coating die is one of a slide, curtain, bead, or extrusion coating die.

13. The apparatus of claim 11 wherein the slot and surface are parts of a multilayer coating die.

* * * * *